United States Patent [19]

Stultz et al.

[11] Patent Number: 4,817,917

[45] Date of Patent: Apr. 4, 1989

[54] METHOD AND APPARATUS FOR REMOVAL OF STAKES, AND THE LIKE

[76] Inventors: Robert L. Stultz, P.O. Box 251, Magalia, Calif. 95954; James M. Angel, 1647 Young Ave.; Rodney Kopsa, 1765 Sparks Drive, both of Paradise, Calif. 95969

[21] Appl. No.: 396,679

[22] Filed: Jul. 9, 1982

[51] Int. Cl.[4] ..... E21B 19/00

[52] U.S. Cl. ..... 254/30; 29/267; 254/131

[58] Field of Search ..... 254/21, 22, 30, 113, 254/120, 122, 129, 131; 29/267; 294/92, 118

[56] References Cited

U.S. PATENT DOCUMENTS

| | | | |
|---|---|---|---|
| 557,259 | 3/1896 | Donnelly | 254/131 |
| 1,116,699 | 11/1914 | Hauswirth | 254/131 |
| 1,269,952 | 6/1918 | Mountain | 254/131 |
| 1,444,280 | 2/1923 | Slough | 29/267 |
| 1,468,344 | 9/1923 | Eckert | 294/118 |
| 1,587,777 | 6/1926 | Juelfs | 29/267 |
| 1,796,084 | 3/1931 | Collison | 29/267 X |
| 2,156,735 | 5/1939 | Packer | 294/118 X |
| 2,777,726 | 1/1957 | Lundgren et al. | 254/30 X |
| 4,161,310 | 7/1979 | Parker | 254/30 |

FOREIGN PATENT DOCUMENTS

| | | | |
|---|---|---|---|
| 494101 | 3/1930 | Fed. Rep. of Germany | 254/131 |

*Primary Examiner*—Frederick R. Schmidt
*Assistant Examiner*—Judy J. Hartman
*Attorney, Agent, or Firm*—Herbert C. Schulze

[57] ABSTRACT

This invention is a method and an apparatus for performing the method, for the removal of stakes, such as concrete foundation stakes, and other stakes or posts driven into the ground. The method is characterized by gripping with a pair of hardened arms at a position on each stake, or the like, to be removed with a leverage being applied from a position above the gripping point on such stakes to a resting upon position upon foundation framing, or other suitable support. The method incorporates repeated pulling from different positions in a manner as set forth until the item being removed from the ground is fully removed.

7 Claims, 3 Drawing Sheets

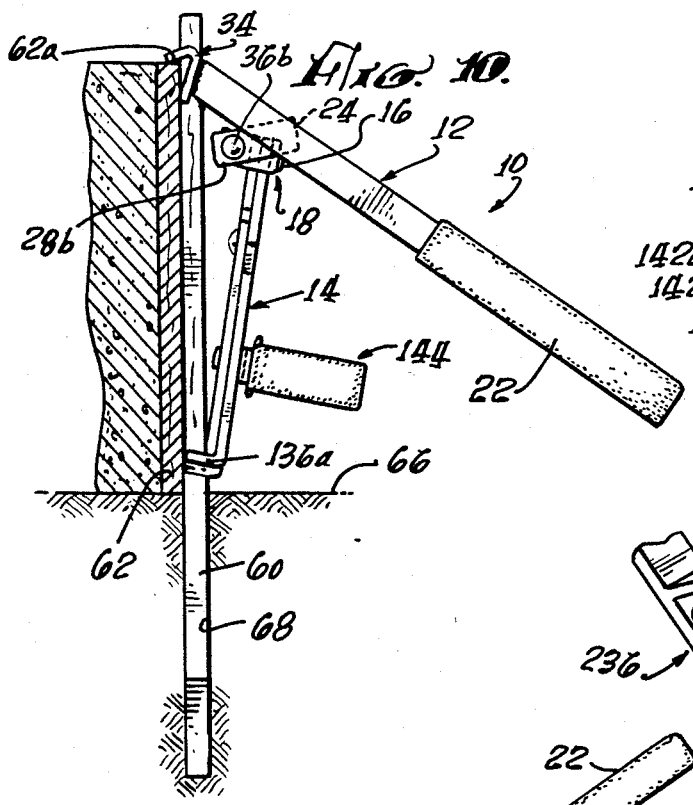
FIG. 10.
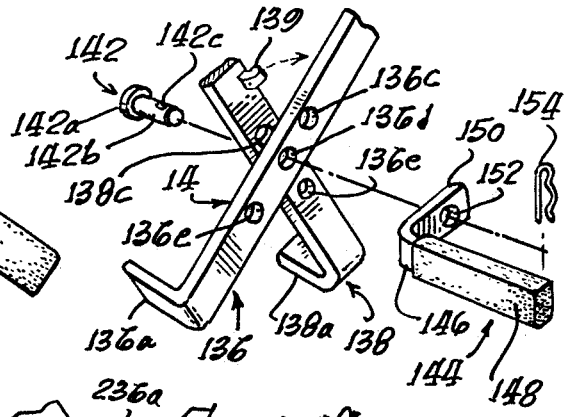
FIG. 12.
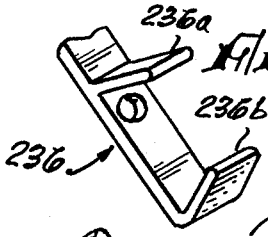
FIG. 14.
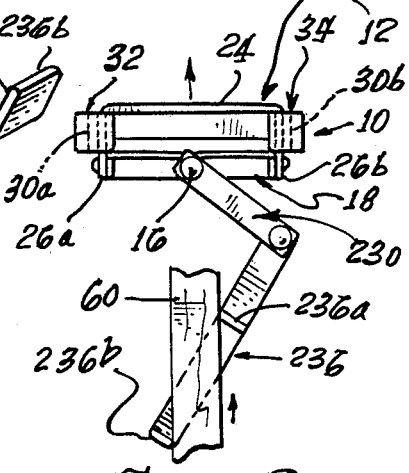
FIG. 13.
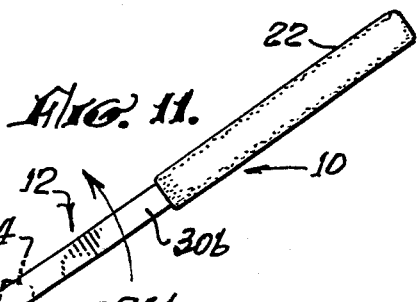
FIG. 11.
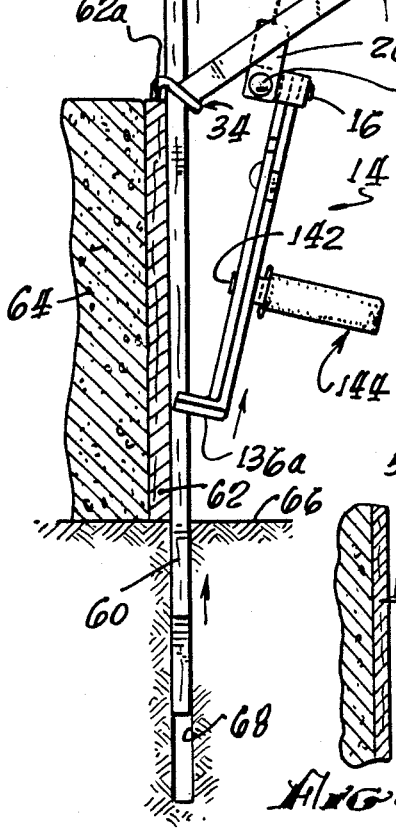
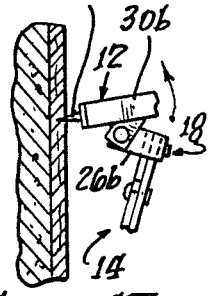
FIG. 17.
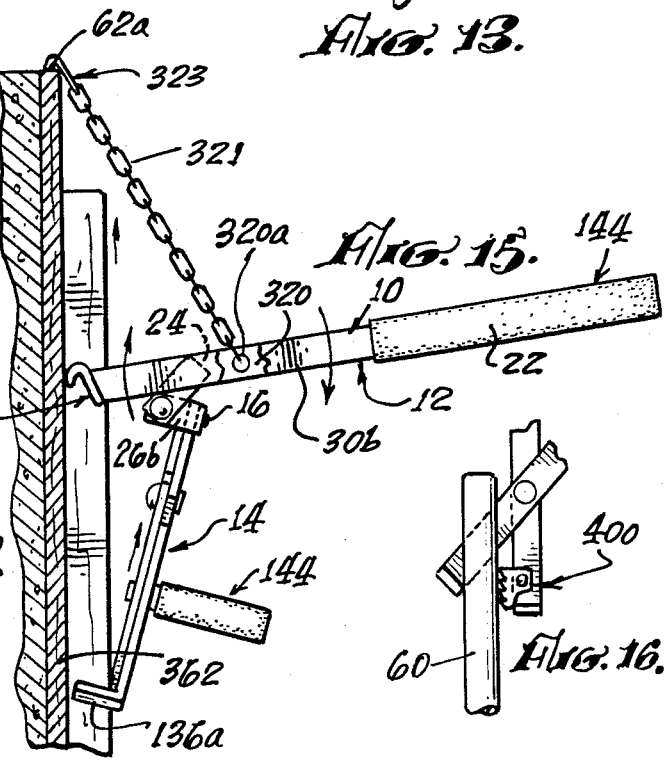
FIG. 15.
FIG. 16.

METHOD AND APPARATUS FOR REMOVAL OF STAKES, AND THE LIKE

CROSS REFERENCE TO RELATED PATENT APPLICATIONS

There are no pending patent applications filed by us related to the within application with the exception of the design patent application being filed concurrently herewith for a design for Leverage Tool Support Member. There has been a disclosure document recorded by us bearing No. 098301 filed on Mar. 5, 1981 in the U.S. Patent and Trademark Office.

BACKGROUND OF THE INVENTION

1. Field of the Invention

This invention is in the general field of devices for removal of stakes, or the like, which have been driven into, or otherwise placed within the ground. The invention is further directed to a method specifically directed to removal of such items from the ground wherein leverage is applied to foundation members, or the like, associated with stakes, or the like, driven into the ground. The invention is even more directed to a method and apparatus for practicing the method wherein a pair of cooperative arms may grip a stake, or the like, and by leverage applied to an associated foundation member, or the like, remove the same in successive steps. The invention is even more particularly directed to such a method and apparatus wherein the stake, or the like, in being removed may be gripped on two edges, or a portion of two edges without the necessity of gripping all around the stake, or the like.

2. Description of the Prior Art

There have been certain devices manufactured and used for the removal of stakes, posts, and the like, driven into the ground. Usually such items will consist of gripping members such as complex cam arrangements, cables, ropes, or the like, completely surrounding such stake, or the like, and similar means activated by winches or jack-like arrangements operating from a base position adjacent the ground into which the stake, or the like, has been previously inserted.

The present method and apparatus involves a simplified and very effective mechanism which may be utilized by gripping a stake, or the like, upon two sides only so that if it in contact with some other object it is not necessary surround it nor to have suitable ground position for placement of a jack, or the like, and wherein an associated foundation, or the like, may be used as a leverage position. In this respect the present invention is totally unique as compared to any existing prior art known to us.

SUMMARY OF THE INVENTION

In the construction industry, and in other industries, it is frequently necessary to drive stakes, posts, and the line, into the ground to support foundation members, or the like. Such stakes and posts become very difficult to remove under most circumstances since they are generally directly pressing against the foundation members, or the like, and thus when it is time to remove such stakes, or the like, it is very difficult to get an appropriate bearing position to exert force against such stakes.

It is most common to remove foundation stakes by either breaking them off, or hitting them repeatadly with hammers, and the like, to loosen them in the ground. Such procedures are costly and usually result in the destruction of such stakes and create additional cost and expense by reason of excessive time required.

There have been some developments towards devices designed to extract stakes, and the like, from the ground by applying force to them in an upward direction. Such devices have included cam-like jaws to grip a stake under excessive pressure and then to cooperate with a jack, or the like, resting upon the ground adjacent the stake. Likewise, there have been cables, and the like, used around the stakes and such stakes have then been removed by lifting with a winch, or the like, upon such stakes.

All of the past methods have been difficult and expensive since many times the stakes are in such locations that the ground is not capable of providing suitable support for the jack, or the like, and also there may not be clearance around the stake for cables, and the like, since most of such stakes are for the purpose of holding foundation boards, or the like, in a proper and upright position.

Some devices have attempted to rest upon the top of a concrete wall, or the like, which was formed utilizing such stakes and boards, and the like, which they held in place.

We have studied the problem extensively and have now conceived and developed a method, and an apparatus for practicing the method, wherein we can apply proper upward force to a stake which is driven into the ground which force is transmitted to the stake through a pantograph-like arm arrangement and a pair of opposed arms depending therefrom which suitably grip upon the edge of a stake or post, whether made of wood, plastic, metal or whatever.

The unique method further incorporates the application of leverage pressure to an associated structure such as the upper edge of form material, or the like, and thus there can be no damage to the set concrete within the form or to other structural members. At the same time, the manner in which the forces applied to remove the stake are such that the stake, or the like, is not destroyed and may be used over and over again.

In some alternate embodiments, auxiliary stands, and the like, can be utilized as a leverage position, and certain other types sharpened members may be utilized to grip and insert into the form, or the like, for the application of suitable pressure.

It is an object of this invention to provide a method and apparatus as set forth wherein such stakes that have been driven into the ground may be removed by pressure applied on adjacent and cooperative structural members.

Another object of this invention is to provide such a method and apparatus for the removal of stakes wherein foundations, and the like, which have been poured within members supported by the stakes will not be damaged.

Another object of this invention is to provide a method and apparatus for removing stakes wherein the stake, or the like, is gripped from two sides by a pair of cooperative arms.

Another object of this invention is to provide a method and apparatus for the removal of stakes, and the like, driven into the ground wherein a pair of opposed and cooperative members having hardened edges grip into a stake, or the like, to apply pressure for extraction from the ground.

The foregoing and other objects and advantages of this invention will become apparent to those skilled in the art upon reading a description of a preferred embodiment which follows, in conjuntion with a review of the appended drawings.

BRIEF DESCRIPTION OF THE DRAWINGS

FIGS. 10 and 11 are side elevations of the device of FIG. 1 showing different positions of the stake pulling device during the pulling operation;

FIG. 12 is an exploded perspective of a lower portion of the device of FIG. 1, but with a slight modification;

FIG. 13 is a simplified view showing the action of an alternate embodiment;

FIG. 14 is a fragmentary perspective of the lower end of the device of FIG. 13;

FIG. 15 is a side elevation of an alternate method of pulling stakes utilizing an attachment;

FIG. 16 is a fragmentary side elevation similar to FIG. 2, but showing an attachment that can be applied toward the pulling of steel rod stakes; and FIG. 17 is a fragmentary side elevation of the holder of the invention as being applied to the side of a concrete board for establishing a pivot point.

DESCRIPTION OF A PREFERRED EMBODIMENT

Figure 1:
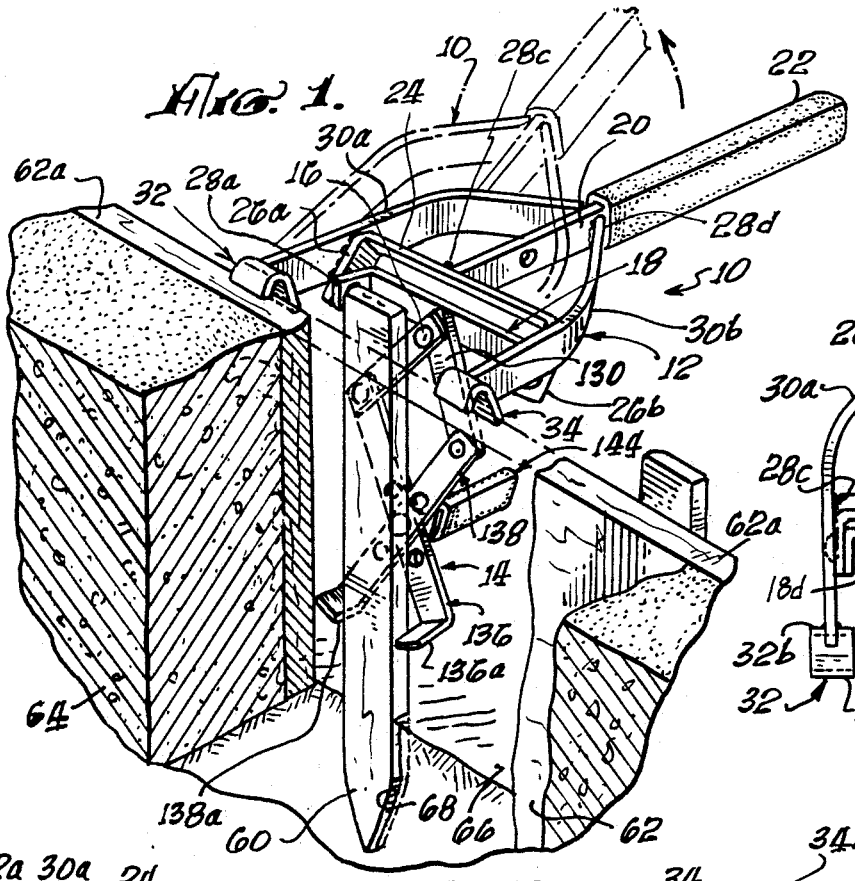
FIG. 1 is a perspective view, with parts shown in section, of the stake and post puller of our invention as it is placed into position to effect the pulling operation.

In the drawings, we have shown in FIG. 1 a perspective view of the stake and post puller of our invention in position for withdrawing a stake from the ground alongside of a concrete form.

The puller tool, shown in its entirety at 10, is comprised of a frame assembly 12, linkage 14, pivotally supported to the frame at 16 of a pivotally supported "U"-shaped member 18.

A central handle 20, having a rubberd-grip portion 22, is shown to be affixed to an elongated member 24. The member 24 has ear extensions 26*a* and 26*b* at its ends. Openings 26*a'* and 26*b'* are shown in the extensions for a purpose to be shown later in the specification.

Weldments 28*a*, 28*b* and 28*c* form an integral unit of the frame member 12. Weldment 28*d* ties the side arms of yoke 30 to the handle 20. These side arms are shown at 30*a* and 30*b*. We have located a pair of fulcrum members at 32 and 34 which are attached to the ends of arms 30*a* and 30*b* for the purpose of placing the tool handle upon the edge of a concrete form when it is in place to remove stakes alongside the form.

Figure 4:
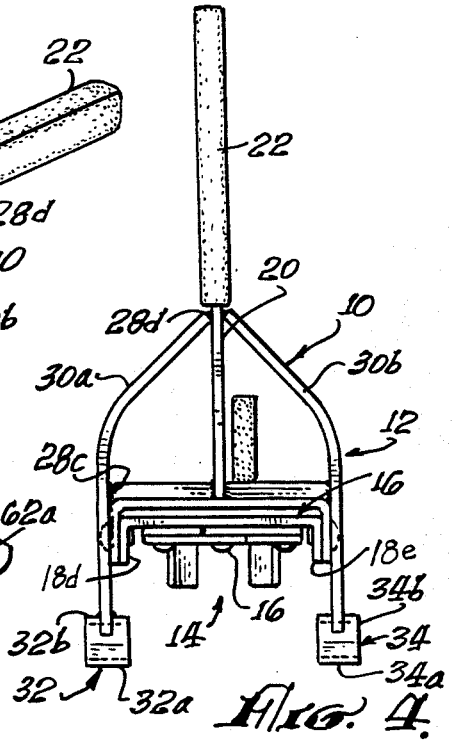
FIG. 4 is a top plan view of the device of FIG. 1.
Figure 3:
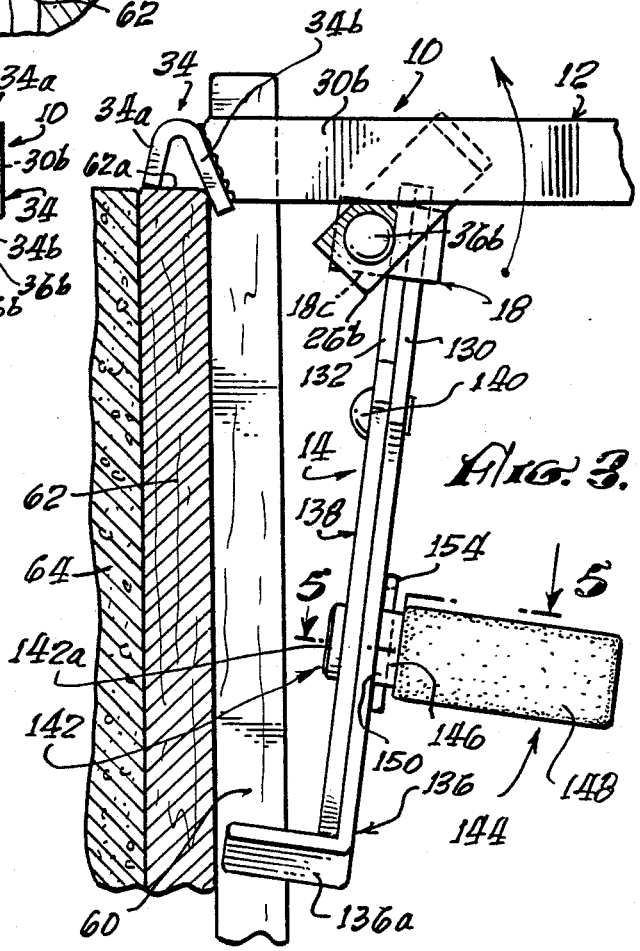
FIG. 3 is a side elevation as viewed from the right side of FIG. 2 and shows certain parts broken away.

These fulcrum members have short extensions 32*a* and longer extensions 32*b* along with shorter and longer members 34*a* and 34*b* as is shown in FIGS. 3 and 4. These fulcrum members are formed in such a manner that they would not normally extend far enough over the top of the concrete form so as to damage the freshly hardened concrete, or the like.

Rivets, or pivot pins, are shown at 36*a* and 36*b* in order that the elongated arm member 18 can be pivotally supported between the ears 26*a* and 26*b*. Openings 18*a* and 18*b* are placed in the extensions 18*d* and 18*e* to allow the rivets 36*a* and 36*b* to be passed through openings 26*a'* and 26*b'* and the holes 18*a* and 18*b*, respectively.

An opening 18*c* is located midway between ears 18*d* and 18*e* of the member 18 for the purpose of pivotally supporting a linkeage assembly of the invention.

We have shown a linkeage assembly at 14 which performs the functions of the invention that grip the stake for removal from the ground in such a manner that has been proven unique in the field. A first pair of links 130 and 132 are shown in the side elevation of FIG. 2 and the exploded perspective of FIG. 6.

These links have openings 130*a*, 130*b*, 132*a* and 132*b*, respectively, which allow connecting pivot pins or rivets to pass therethrough. The pivot pin 16, for instance, passes through the openings 132*a*, 130*a* and 18*c* to secure the element to the bar 18.

Gripping links are shown at 136 and 138 which each are provided with a series of openings therein. Extensions 136*a* and 138*a* are shown extending at a normal plane than that of the respective gripping links, and are the actually contacting elements that come against the sides of various stakes that are to be withdrawn from the ground.

Figure 2:
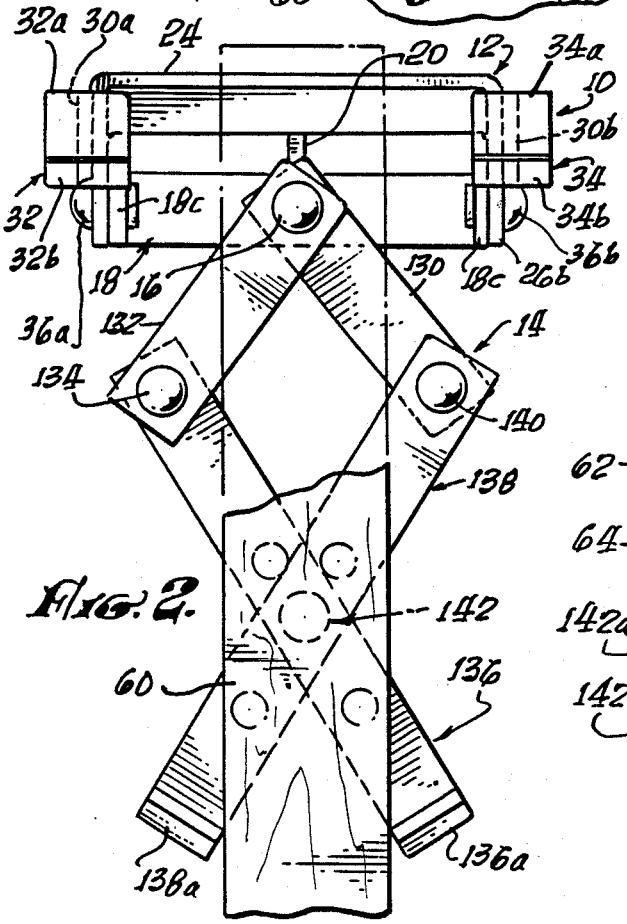
FIG. 2 is an enlarged elevation, with parts broken away, of the device of FIG. 1.

These gripping links each have a series of openings shown at 136*b*, 138*b*, 136*c*, 138*c*, 136*d*, 138*d*, 136*e* and 138*e*. The alignment of all of these openings with one another, as shown in FIGS. 2, 8 and 9 show that they can be aligned in such manner as to accommodate many positions to handle many types of stakes.

A pin 134 connects the upper end of link 136 to the lower end of link 132 through openings 136*b* and 132*b*, respectively. Accordingly, pin 140 connects links 138 and 136 by passing through the openings 138*b* and 130*b*, respectively.

An especial connecting pin 142 is shown to pass through selected sets of openings in arms 136 and 138 and then through a small second handle as will be described in detail herewith. This pin 142 has a head 142*a*, a pin portion 142*b* and a small hole 142*c* for the purpose of passing a lock pin therethrough.

Figures 5, 6, 7, 8, 8A, 9:
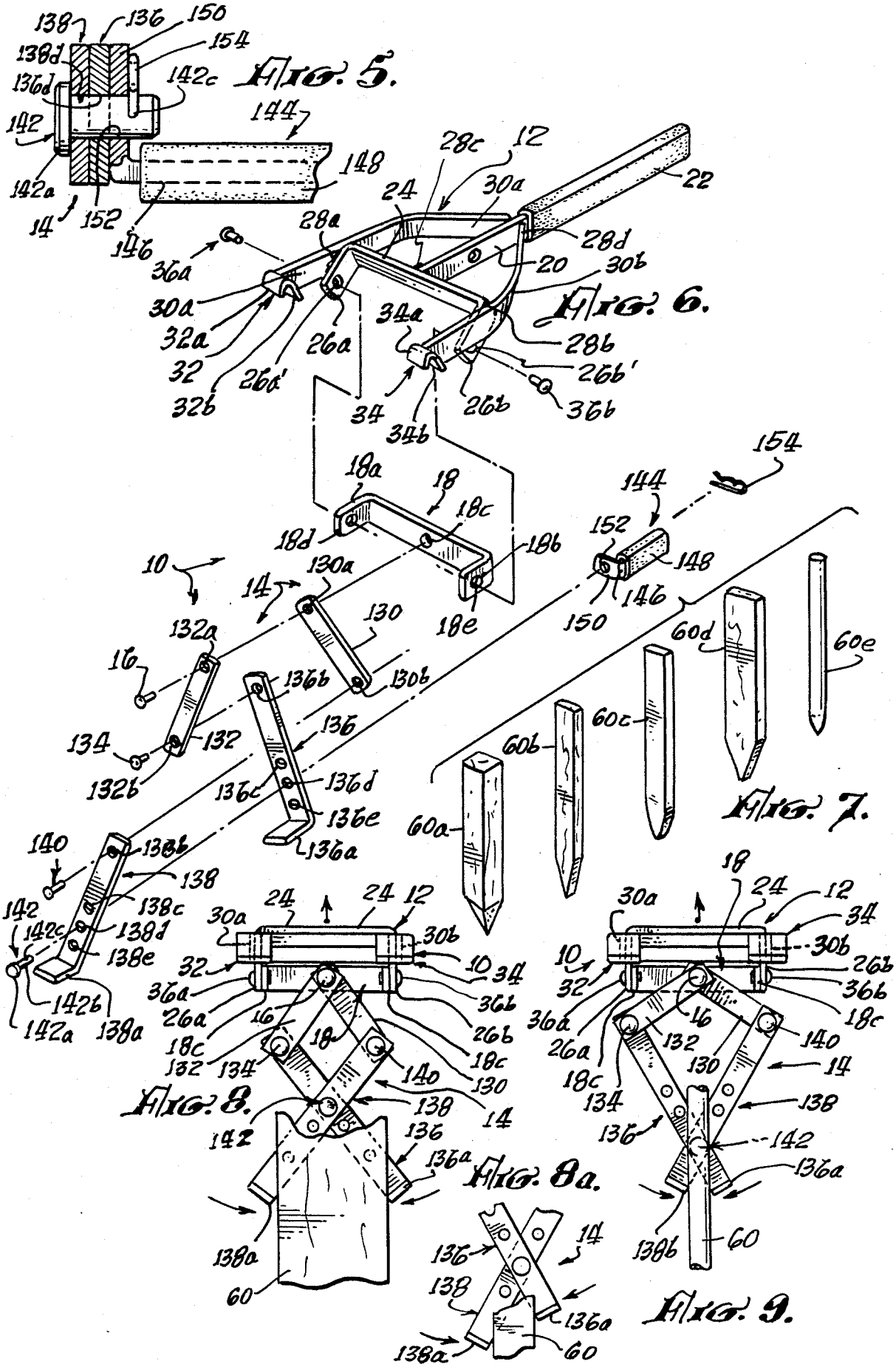
FIG. 5 is an enlarged section as viewed on line 5—5 of FIG. 3.
FIG. 6 is an explosed perpsective view of the components of the device of FIG. 1.
FIG. 7 is a perspective of several types of stakes and posts that can be withdrawn from the ground after they have been driven into such ground.
FIGS. 8, 8*a* and 9 are elevations, in simplified form, of other actions and adjustments that allow the device of FIGS. 1 through 6 to pull up different types of stakes.

As viewed in FIG. 6 and in FIG. 12, the second handle 144 has a metal extension 146 and an offset portion 150. This extension handle 144 has an opening 152 through the aforementioned offset portion in order to allow the pin 142 th pass therethrough for the acceptance of of the locking pin 154.

When the finally assembled linkage assembly is put together and supported in the frame 30, the tool is ready for use.

We have shown in the various figures the manner in which the tool is first supported onto the top surface of a concrete form. The various stakes, as shown in FIG. 7, comprise rectangular wood types as shown at 60*a*, narrow flat wood stakes 60*b*, steel or fiberglass stakes 60*c*, wide wood flat stakes 60*d* and conventional cylindrical steel post-type stakes 60*e*. The present tool can be adapted to remove all of these and other types of stakes that are well known in the art.

In FIG. 1 and in FIG. 3 we have shown the form board 62 with its upper surface 62*a* as forming the pouring of concrete 64 onto the ground 66. The hole formed by the stake that has been driven into the ground is shown at 68.

FIG. 1 shows that the tool has been placed on the upper surface 62*a* and by means of the handle, the linkage 14 has been maneuvered by an operator grasping the handle 144 and moving it to straddle the stake with the extensions 136*a* and 136*b*. Then the operator lifts the handle 22 to the position shown in FIG. 11. The stake is shown to be partially removed. The operator then operates the handle 22 back to an initial position as shown in FIG. 10 and the procedure is again repeated until the stake has been loosened for hand removal or until the stake has been fully extracted.

In order to keep the linkeage from jamming when it is being actuated, a stop tab 139 is shown in FIG. 12 as being placed on the gripper arm 138 in such a position so as to keep the pair of arms 136 and 138 from completing the collapse of the linkeage into a jammed position. Lubrication of all the pivot points aids in the smooth operation of the tool during use.

FIG. 13 shows an alternate embodiment in which 230 and 236 are utilized for gripping a stake by the addition of projections 236*a* and 236*b* extending from the gripper bar 236. The extensions are shown to be angularly disposed toward one another to compensate for the bending of the hardened metal during a gripping operation.

The perspective of FIG. 14 shows the lower end of the bar 236 having its pivot point at a different location than that shown in FIG. 13.

FIG. 15 shows the fact that a stake can be removed in somewhat a different manner while utilizing te same mechanism as described previously by simply providing an opening 320*a* in the handle 320 so that a chain 321 can be attached to support the tool atop a form board 362 of a larger height from the ground than the form boards shown previously. The operator pushes the handle downwardly, rather than upwardly, ih order that the mechanism can pull up the stake from the ground. A clip member 323 is shown provided in order be able to hand the tool on the upper surface.

FIG. 16 shows that a hardened steel jaw element as shown at 400 can be attached to one of the arms of the gripper assembly in order to bite into and to better grip certain types of stakes.

When there is no other method of supporting the fulcrum portion of the tool, or nowhere to hand the aforementioned chain, we have provided prongs 500 to the end of the frame in order to press these prongs into the wood form and in effect provide an anchoring point for the pivotal action.

The illustration in FIG. 17 can also be expanded to make the support member into which the prong extends a support other than the form itself. Subsequently, the fulcrum end of the tool can be placed on a member resting on the ground which is other than the actual form board itself.

While the embodiments of this invention shown and described are fully capable of achieving the objects and advantages desired, it is to be understood that such embodiments have been for purposes of illustration only, and not for the purpose of limitation.

We claim:

1. Apparatus for removing stakes, or the like, which are partially imbedded in the ground comprising: a leverage member having an elongated handle means on one end and means for contacting a leverage position on the other end; a pair of interconnected arms pivotally mounted upon said leverage member; a pair of gripping arms connected to said pivotally mounted arms in such manner that they can contact opposed sides of a stake, or the like, partially imbedded in the ground.

2. The Apparatus of claim 1 wherein the means for contacting a leverage position comprises two support members suitable to rest upon the top of a concrete form member.

3. The Apparatus of claim 1 wherein said means for contacting a leverage position comprises a support member suitable to rest upon the top of a concrete form member and is interconnected by a flexible connector means to a point on said leverage member in such a position so as to move said stake out of the ground by pivotally moving said handle in a downward motion.

4. The Apparatus of claim 1 wherein said gripping arms are provided with a hardened gripper means for applying pressure to the sides of said stake.

5. The Apparatus of claim 1 wherein said gripping arms are pivotally interconnected and provided with means for changing said pivotal interconnecting point along said gripping arms to adapt for different widths of stakes.

6. The apparatus of claim 1 wherein the said means for contacting a leverage position comprises an essentially "V" shaped element attached to the other end of said handle, and wherein the gripping arms comprise elongated members having depending ends at 90° to said enlongated members, and wherein the said elongated members are pivotably connected together in such manner that the length of the elongated member from the pivotable connection to the depending end may be adjusted, and wherein said handle has supplemental support means intermediate its handle means and means for contacting a leverage position flexibly connectable to an auxiliary support position.

7. The method of removing stakes which have been driven into the ground from the ground comprising: gripping the stake on diametrically opposed sides with a pair of arms which are cooperatively hinged to one another in such manner that they may move inwardly towards one another against the sides of the stake, or the like while they are in contact; connecting said cooperative arms to a leverage member structure; exerting pressure against said arms in contact with said stakes by pivoting said leverage member structure upon at least one point against a member cooperative with a structural purpose of said stake comprising the edge of a concrete form held in position by said stake.

* * * * *